United States Patent [19]

Tanikawa

[11] 4,221,502

[45] Sep. 9, 1980

[54] CULVERT JOINT

[75] Inventor: Takayoshi Tanikawa, Zentsuji, Japan

[73] Assignee: Seibu Polymer Kasei Kabushiki Kaisha, Zentsuji, Japan

[21] Appl. No.: 13,921

[22] Filed: Feb. 22, 1979

[30] Foreign Application Priority Data

Feb. 28, 1978 [JP] Japan ..... 53-21524

[51] Int. Cl.[3] ..... E01F 5/00; F16L 27/00

[52] U.S. Cl. ..... 405/126; 52/396; 285/114; 285/226; 404/68; 405/136

[58] Field of Search ..... 405/124, 126, 136; 404/47, 68, 69; 14/16.1; 52/396; 285/226, 227, 228, 114, 229, 288, 230; 138/55

[56] References Cited

U.S. PATENT DOCUMENTS

| | | | |
|---|---|---|---|
| 3,112,579 | 12/1963 | Needham et al. | 405/135 |
| 3,344,720 | 10/1967 | Hallock | 404/47 |
| 3,390,501 | 7/1968 | Driggens | 404/47 X |
| 3,704,034 | 11/1972 | Shire et al. | 285/114 X |
| 3,725,565 | 4/1973 | Schmidt | 285/226 X |
| 3,729,939 | 5/1973 | Shimizu | 405/136 |
| 3,750,359 | 8/1973 | Balzer et al. | 52/396 X |
| 3,974,614 | 8/1976 | Strong | 404/68 |
| 4,027,902 | 6/1977 | Tanikawa | 285/226 X |

FOREIGN PATENT DOCUMENTS

| | | | |
|---|---|---|---|
| 2228599 | 8/1973 | Fed. Rep. of Germany | 404/68 |

*Primary Examiner*—Dennis L. Taylor
*Attorney, Agent, or Firm*—Brisebois & Kruger

[57] ABSTRACT

The present invention relates to a flexible joint to be inserted between culvert sections. In a culvert joint which consists of anchor members attached to the opposing culvert sections, a flexible member extending between said anchor members and a large number of strengthening members arranged in parallel at the internal and external positions of said flexible member, said strengthening members being classified into one with projections and one with holes to regulate the distance between them; the projections of said member with projections fit into the holes of said member with holes to overlap each other, thereby regulating the distance between them to follow an expansion and contraction or an uneven subsidence of the culvert and therefore, bearing earth pressure sufficiently.

16 Claims, 15 Drawing Figures

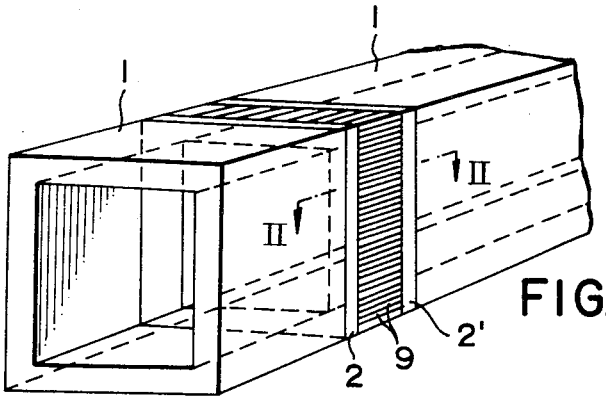
FIG. 1
FIG. 2
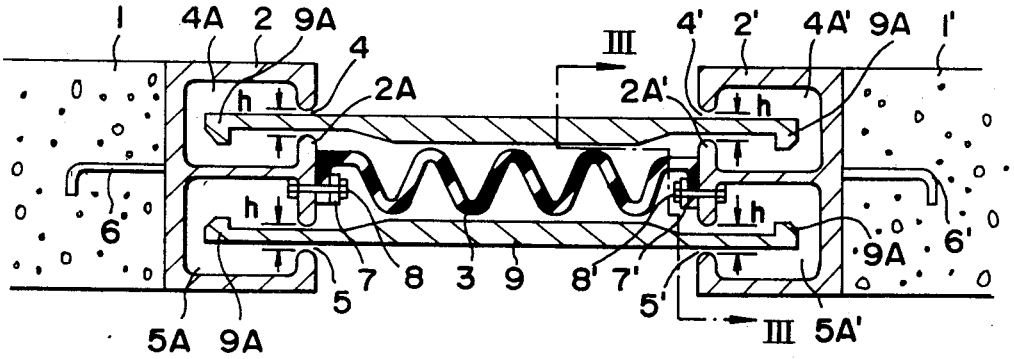
FIG. 3
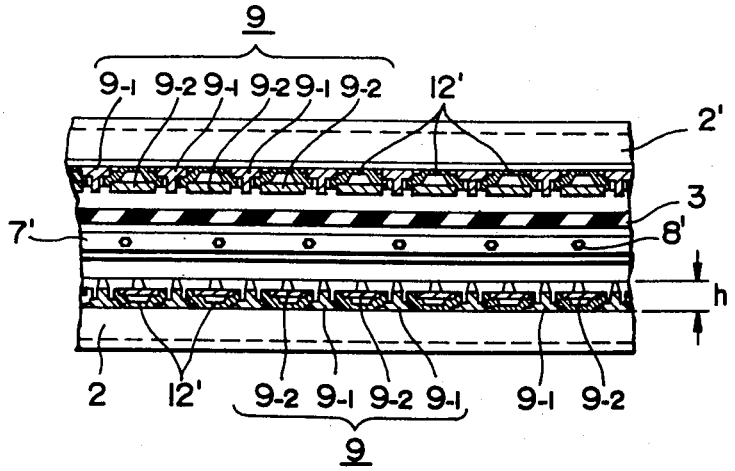

CULVERT JOINT

BACKGROUND OF THE INVENTION (1) Field of the Invention

The present invention relates to a culvert joint which can follow an expansion and contraction of distance or an uneven subsidence between the opposing culvert sections, more specifically to a culvert joint designed to regulate the distance between its strengthening members which bear the earth pressure.

(2) Description of the Prior Art

In the conventional joint for concrete culvert, an elastic material like rubber or synthetic resin is employed to constitute the junction of the culvert; the two ends of a short tubular flexible member are anchored around the inside surfaces of opposing culvert sections or the flexible member is bolted at the rear to suspend a part of said member, thereby minimizing the distortion in the flexible member due to difference between internal and external water pressure in the culvert. In both cases, the earth pressure acting at the junction of culvert sections is borne by a concrete mass poured behind the whole flexible member so that the flexible member simply bears the internal water pressure or the underground water pressure.

Thus in the event of a heavy uneven subsidence of the ground or displacement of the culvert sections in a longitudinal direction or in a direction perpendicular to the longitudinal direction during an earthquake, with result that the gap at the junction remarkably widens, the mud and sand located around the culvert come into direct contact with the flexible member, causing a heavy earth pressure to act directly on the flexible member, whereupon a harmful distortion develops in the flexible member and not only is the water flow impeded, but also the flexible member loses its durability or is broken very often.

To eliminate these troubles, various measures are taken. For instance, anchor members which have a seat for fitting the flexible member and cavities at the inside and outside of the seat are respectively provided at the opposed open ends of culvert sections to be joined together. A short tubular flexible member made of rubber or synthetic resin to smoothly absorb a heavy uneven subsidence in a state of maintaining watertightness of joint block is provided extending over the seats of the opposed anchor members, while a large number of strengthening members to withstand the water pressure and earth pressure at the internal and external positions of the flexible member and transmit these forces to said anchor members, are provided in such an arrangement that both ends of the strengthening members are held displaceable to a certain extent within the cavities of said anchor members. Thus said short tubular flexible member is wholly protected, thereby preventing it from being damaged from inside and outside by rolling stones, mud and sand, wood, iron piece or water.

In a joint having such a strengthening member, however, numerous parallel gaps must be left between the numerous strengthening members so that the displacement in a direction perpendicular to the longitudinal direction of culvert due to an uneven subsidence of adjacent culvert sections can be smoothly absorbed. Thereby said gap between the strengthening members should be appropriately maintained without moving to one side so that mud and sand around the outside of the joint blocks may not enter to the flexible member through the gaps between the strengthening members.

It is conceivable to provide a padding at the gap for the purpose of preventing entry of mud and sand through the gap, but such a padding must be a soft, elastic material like sponge rubber with a relatively low resilience or a filler such as a plastic one like asphalt or putty, so that the resistance to deformation of the junction under progress of uneven subsidence can be minimized. However, the low resilience and plastic deformability of the fillers are likely in the junction of underground culvert to result in that with progress of uneven subsidence the mud and sand around the junction causes the distances between the strengthening members to become uneven and in consequence the strengthening members to move to one side, thereby developing a gap between them which permits penetration of mud and sand and consequent decrease of durability or damage of the flexible member as mentioned before. Thus even when a padding is provided between the strengthening members, the regulation of their distance is important.

The penetration of mud and sand through the gap caused by moved strengthening members restrains a free displacement of the flexible member which is required to follow the uneven subsidence of the culvert, thereby causing damage to the flexible member; when water is flowing in the culvert, the resistance to water flow increases owing to the smoothness of internal surface at the junction being impeded, leading to a drop in the joint performance and in the joint durability.

SUMMARY OF THE INVENTION

The object of the present invention is to provide a culvert joint characterized in that it comprises two types of strengthening members, one with projections and the other with holes and the distance between the strengthening members can be regulated by appropriate insertion of said projection in one strengthening members into said hole in the other strengthening members in order to eliminate troubles concerning gaps among the strengthening members in a culvert section which provides a plurality of strengthening members in parallel at the internal and external positions of a flexible seal member.

Another object of the present invention is to provide a culvert joint characterized in that a soft padding is set between the strengthening members and through the combined effect of the adjustable distance between the strengthening members and the padding inserted between them, the entry of mud and sand around the flexible member can be prevented.

BRIEF DESCRIPTION OF THE DRAWINGS

FIG. 1 is an oblique view of the junction of culvert sections connected by the joint according to the present invention.

FIG. 2 is a section view taken along the line II—II of FIG. 1.

FIG. 3 is a section view taken along the line III—III of FIG. 2.

DETAILED DESCRIPTION OF PREFERRED EMBODIMENTS

Figure 4:
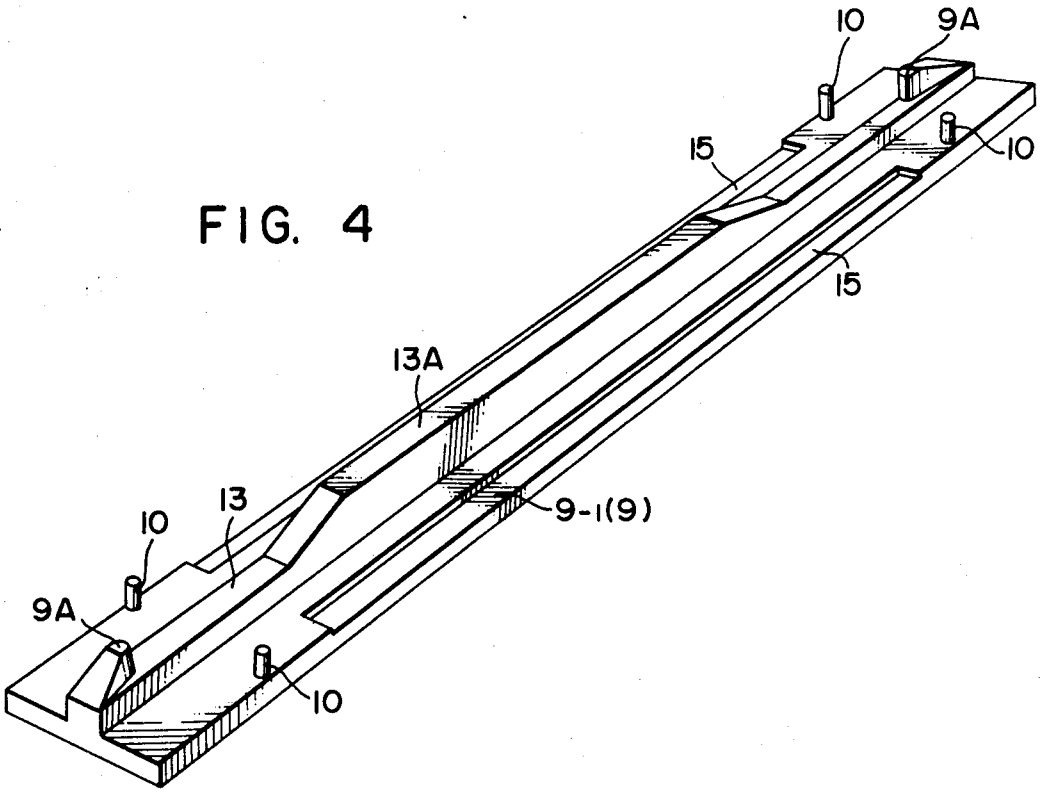
FIG. 4 is an oblique view of strengthening members with projections.

In FIGS. 1 to 3, 1,1' are culvert sections to be joined together, which consist of concrete tubes square, polygonal or circular in cross-section. Anchor members 2,2' are attached to the opposed open ends of the two culvert sections 1,1'. Said anchor members 2,2' are hollow boxes with one side open. The anchor member 2 has, at one end, a seat 2A to fasten a flexible member 3 on its central portion and openings 4,5 at the inside and outside of the seat 2A which communicate with internal cavities 4A,5A. Said anchor member 2 is firmly attached to the concrete culvert 1 by means of an anchor bolt 6. The other anchor member 2' is formed and located with symmetry to said member 2; its description is omitted, with like parts denoted by like symbols, but with a prime (') added.

In the illustrated embodiment said openings 4,5 and 4',5' have a height h.

The flexible member 3 consists of an elastic material with flexibility such as rubber, synthetic resin; as a whole it looks like a short tube with its body having a corrugated section to assure good resilience and minimize its resistance to deformation under uneven subsidence or settling.

The ends of the flexible member 3 are fastened to the opposed seats 2A,2A' of the anchor members 2,2' with bolts and nuts 8,8' with holders such as straps 7,7' applied, to maintain watertightness of the joint.

In the cavities 4A,4A' and 5A,5A' of the anchor members 2,2', are the two ends of a series of strengthening members 9 made of metals such as iron, steel, stainless steel, cast iron, etc. which extend a predetermined distance through the openings 4,4' and 5,5'. Protruded portions 9A are provided at the both ends of the strengthening members 9 within said cavities 4A,4A' and 5A,5A', and permit a relative displacement of the culvert sections 1,1' within a specific range. The height of said protruded portion 9A is set greater than the height h at the opening of said cavities 4A,4A' and 5A,5A' and thus said protruded portion 9A can not slip out of the opening of the cavities 4A,4A' and 5A,5A', thereby preventing the joint from being damaged by preventing the flexible member being displaced beyond its allowable limit.

The anchor members 2,2' are so constructed that parts of the members 2,2' are detachable and the protruded portions 9A of the strengthening members are inserted by detaching said detachable parts of the members 2,2'.

There are two types of the strengthening members 9 which form the series, one $9_{-1}$ (first strengthening member) having projections and the other $9_{-2}$ (second strengthening member) having holes; FIG. 4 illustrates an example of the member $9_{-1}$, which has two projections 10 at positions symmetrical to the longitudinal axis and near the ends, said projection 10 being a dowel extending upright from the surface of the member $9_{-1}$.

Along the center of the member $9_{-1}$ there is a longitudinal raised part or rib 13, which contains a more raised part 13A at the central portion thereof.

Figure 5:
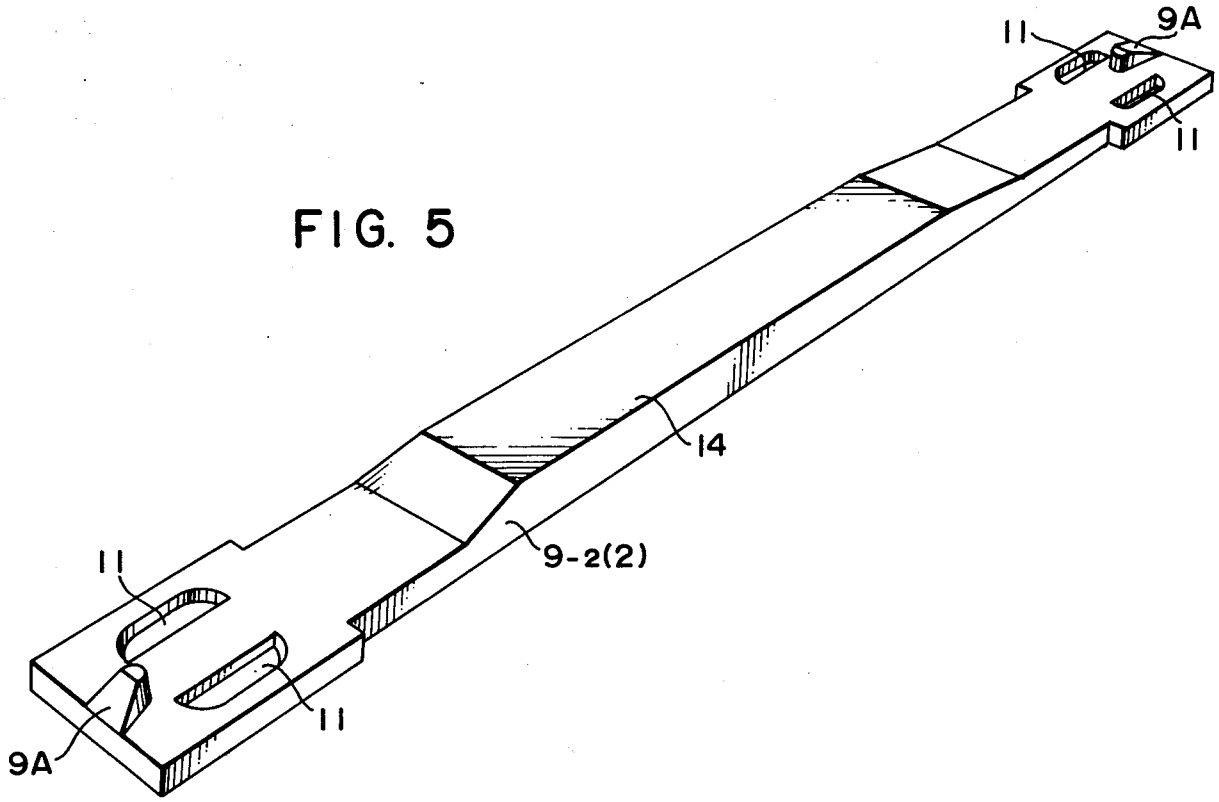
FIG. 5 is an oblique view of the strengthening members with holes.

FIG. 5 illustrates an example of the member $9_{-2}$, which has two holes 11 at positions symmetrical to the longitudinal axis near each end; and at the center of the member $9_{-2}$ there is a longitudinal raised part 14. Said holes 11 receive said projections 10 of the member $9_{-1}$ therein; each hole 11 is a long slot so that the projection 10 positioned at a slot 11 can follow the longitudinal displacement of the strengthening member while in the hole and can freely follow the displacement of the joint within the allowable limit. Each hole 11 is also wider than the projection 10 to permit such movement. Said hole 11 may be semi-circular, semi-elliptical, rectangular in section or it may be a curved, long slot.

The longitudinal ends of the member $9_{31\ 2}$ where the holes 11 are provided are wider than its central part, thereby avoiding decreased strength of the member $9_{-2}$ due to presence of holes.

The intermediate raised part 13(13A) of the member $9_{-1}$ and the raised part 14 of the member $9_{-2}$ serve to prevent an excessive approach of the two strengthening members 9 and also to strengthen them.

Since the member $9_{-2}$ placed between adjacent members $9_{-i}$ is prevented by the raised part 13 (including the part 13A) from coming closer to the member $9_{-1}$ than a specified limit, forces can not concentrate on the projection 10 even when the uneven subsidence has reached the allowable limit, thereby avoiding damage to the projection 10. The raised parts 13A and 14 of the members $9_{-1}$ and $9_{-2}$ are so designed that the top surface of the raised part 13A and the top surface of the raised part 14 may be positioned at the same level to form a uniform flat or curved surface when the members $9_{-1}$ and $9_{-2}$ are overlapped.

Figure 6:
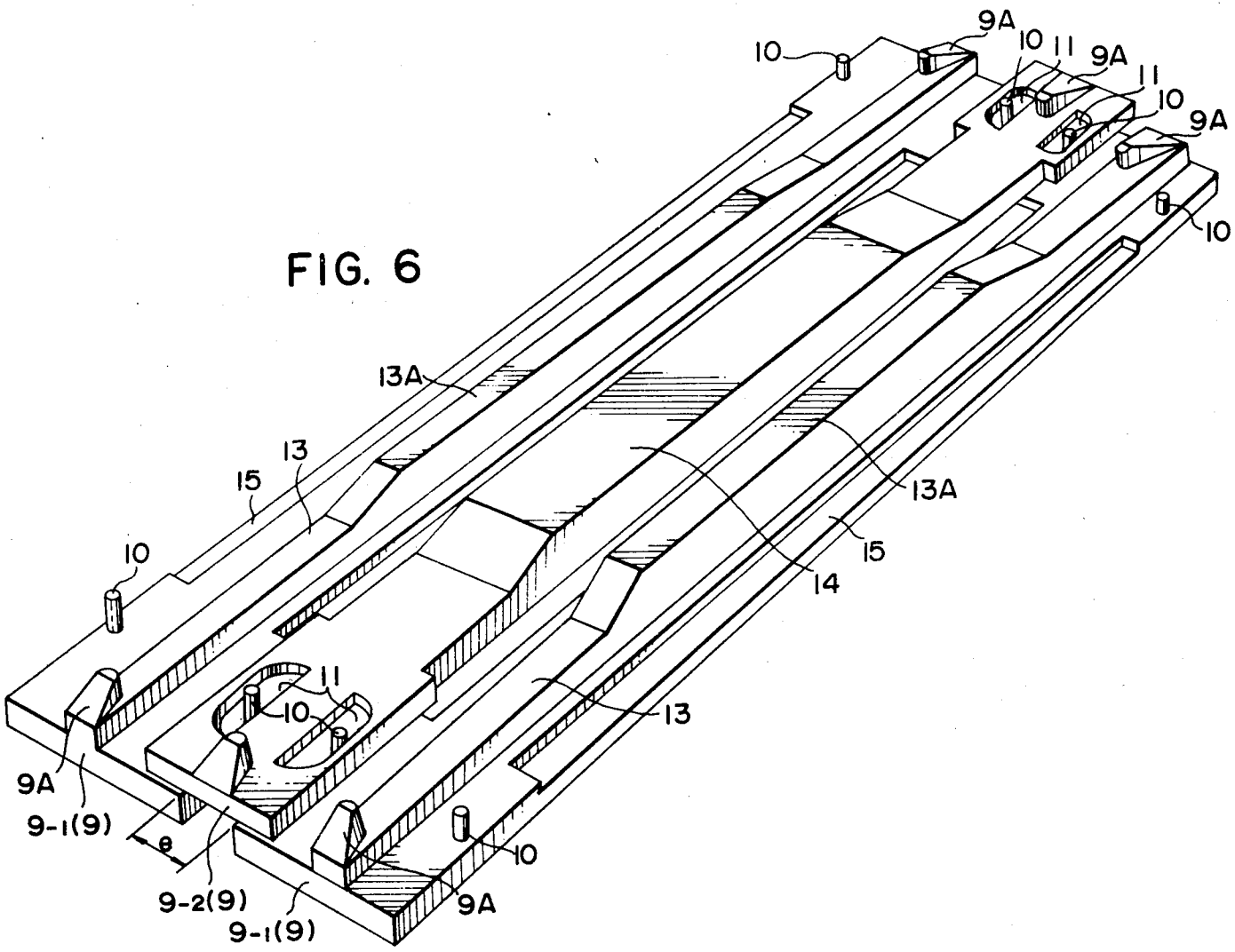
FIG. 6 is an oblique view illustrating a parallel arrangement of the strengthening members in FIGS. 4 and 5.

As indicated in FIG. 6, the members $9_{-1}$ and $9_{-2}$ in the joint are continuously alternated with their sides overlapped so that an assembly of a series of the members $9_{-1}$ and $9_{-2}$ at the internal and external positions of the flexible member 3 constitute a short tubular wall as a whole.

An external group of the strengthening members contact with mud and sand outside the flexible member 3 to directly withstand the earth pressure, the load of which is transmitted via the anchor members 2,2' to the concrete culvert sections 1,1'.

Meanwhile the water pressure inside and outside of the culvert naturally acts directly on said flexible member 3. When the external water pressure acts on the flexible member 3, the flexible member 3 is borne by the internal group of the strengthening members and its load is transmitted via the anchor members 2,2' to the concrete culvert sections 1,1', while when the internal water pressure, if it is larger than the external one, acts on the flexible member 3, the flexible member 3 is borne by the external group of the strengthening members and its load is transmitted via the anchor members 2,2' to the concrete culvert sections 1,1'.

Next, the behavior of the strengthening members under uneven subsidence is to be described.

Figure 7:
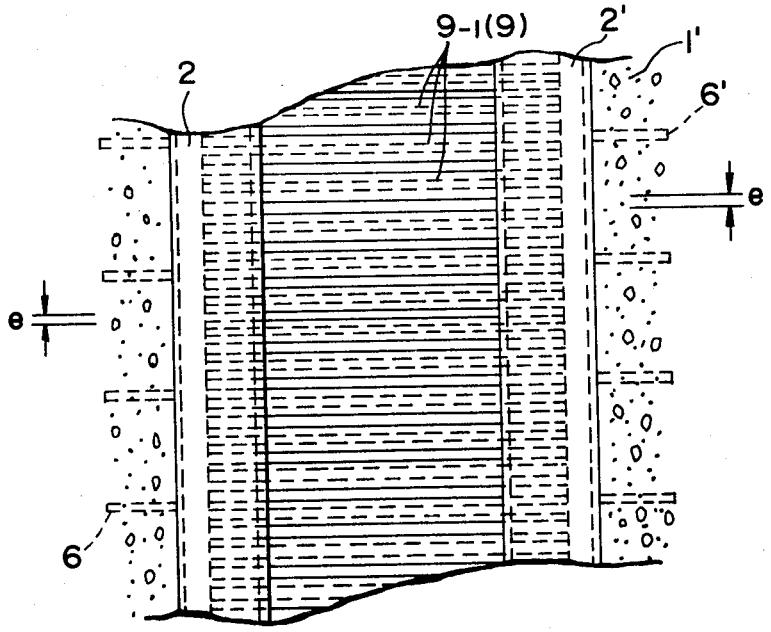
FIGS. 7 and 8 are side views illustrating the behavior of the strengthening members in side portion of the joint at the junction of culvert sections under uneven subsidence, FIG. 7 showing the initial state of the members in the joint as fitted to the two culvert sections and FIG. 8 showing the deformed state of them under uneven subsidence.

In FIG. 7 which illustrates the original state (free from uneven subsidence of the culvert sections 1,1') of the groups of the strengthening members at the joint of culvert sections, the members $9_{-1}$ and $9_{-2}$ are alternately continuously arranged in parallel along the opening of the anchor members 2,2'.

The gap e provided between the sides of adjacent members $9_{-1}$,$9_{-1}$ or the sides of adjacent members $9_{-2}$,$9_{-2}$ arranged in parallel is a necessary one for the joint to be able to smoothly follow to the allowable limit when one or both of the culvert sections 1,1' unevenly subside in a direction perpendicular to the longitudinal direction of the culvert sections 1,1'.

Figure 8:
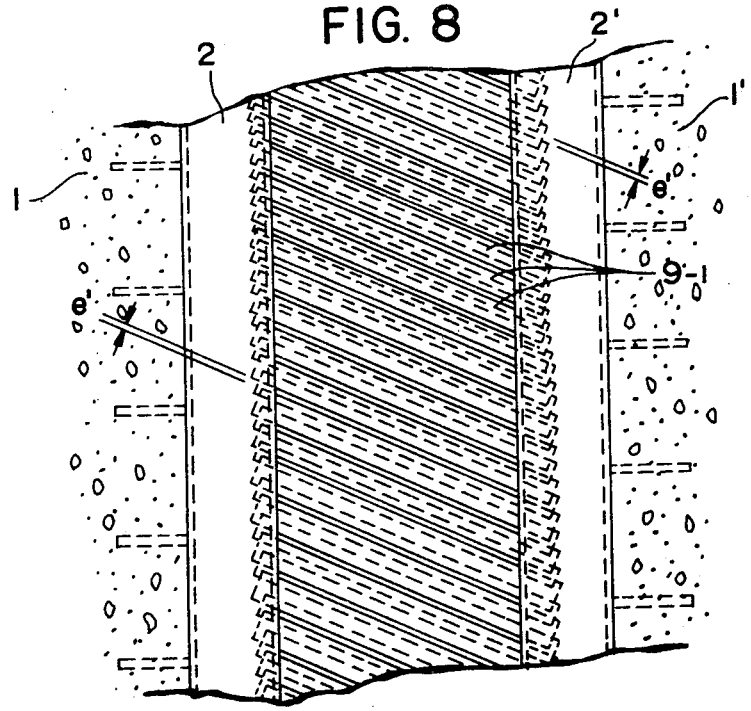
Figure 10:
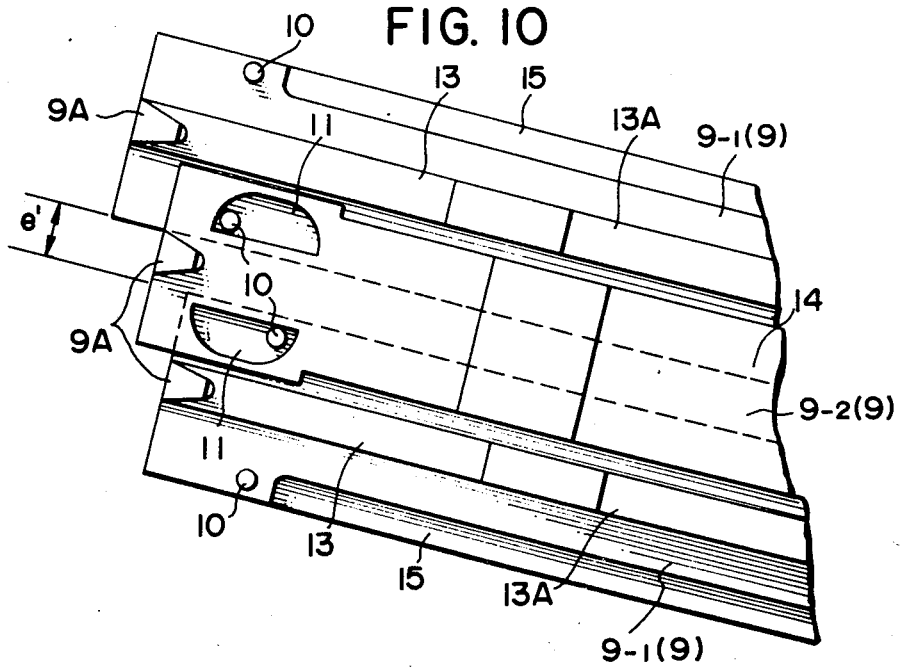

From FIGS. 8 and 10 which illustrate the state of the joint wall tilted due to uneven subsidence of the culvert sections 1,1' it is apparent that the members $9_{-1}$ and $9_{-2}$ are displaced while remaining parallel, being tilted at an angle to the opening between the anchor members 2,2'; and thereby said gap e diminishes to e'.

Figure 9:
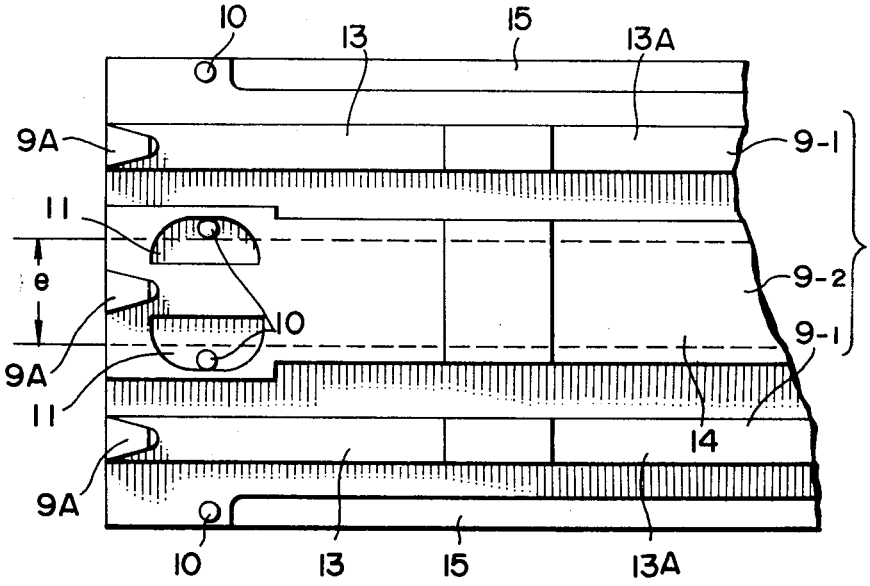
FIGS. 9 and 10 are enlarged partial views of the end of the strengthening member, FIG. 9 showing the state before uneven subsidence takes place and FIG. 10 illustrating the relation between the projection and the hole of the strengthening members at an advanced condition of uneven subsidence.

FIGS. 9 and 10 are enlarged views of the end of the strengthening members, FIG. 9 illustrating the relation between the positions of the projection 10 of the member $9_{-1}$ and the hole 11 of the member $9_{-2}$ in a state free from uneven subsidence; and FIG. 10 illustrating the positions in an advanced state of uneven subsidence.

As seen from FIG. 9, in the initial state of assembly, each projection 10 is located centrally in the hole 11; when the culvert sections 1,1' have displaced in a direction perpendicular to the longitudinal directions of the culvert sections 1,1' and have reached the allowable limit, the projection 10 shifts to an edge in the hole 11, as indicated in FIG. 10, the gap e diminishes to e' and at the same time the widened extreme part at the both ends in the longitudinal direction of the single member $9_{-2}$ hits the side face of the raised part 13 of the member $9_{-1}$, thereby prohibiting further displacement beyond the allowable limit and thus preventing damage to the joint.

Figure 15:
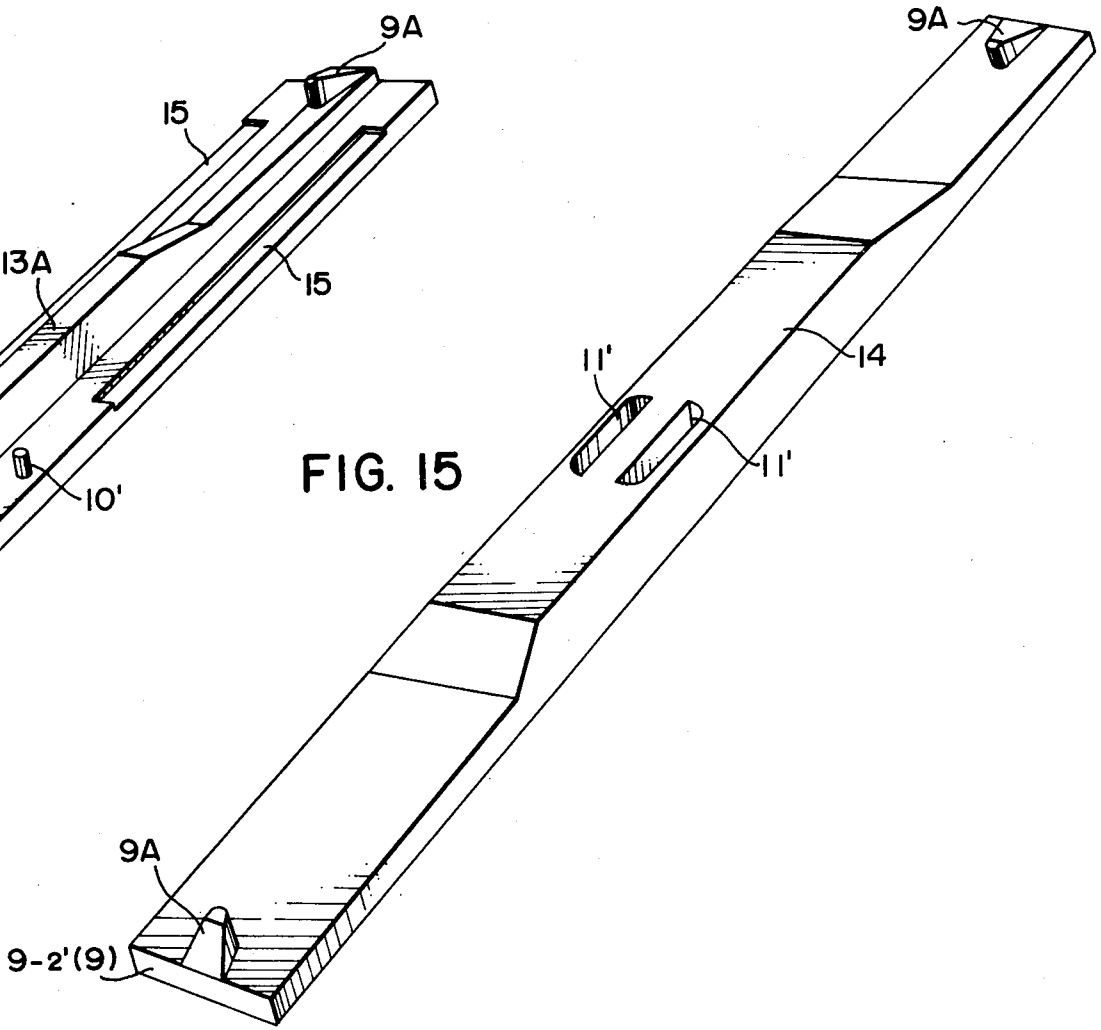
FIGS. 14 and 15 illustrate a different embodiment of the strengthening member, FIG. 14 being an oblique view of a member with projections and FIG. 15 an oblique view of a member with holes.
Figure 14:
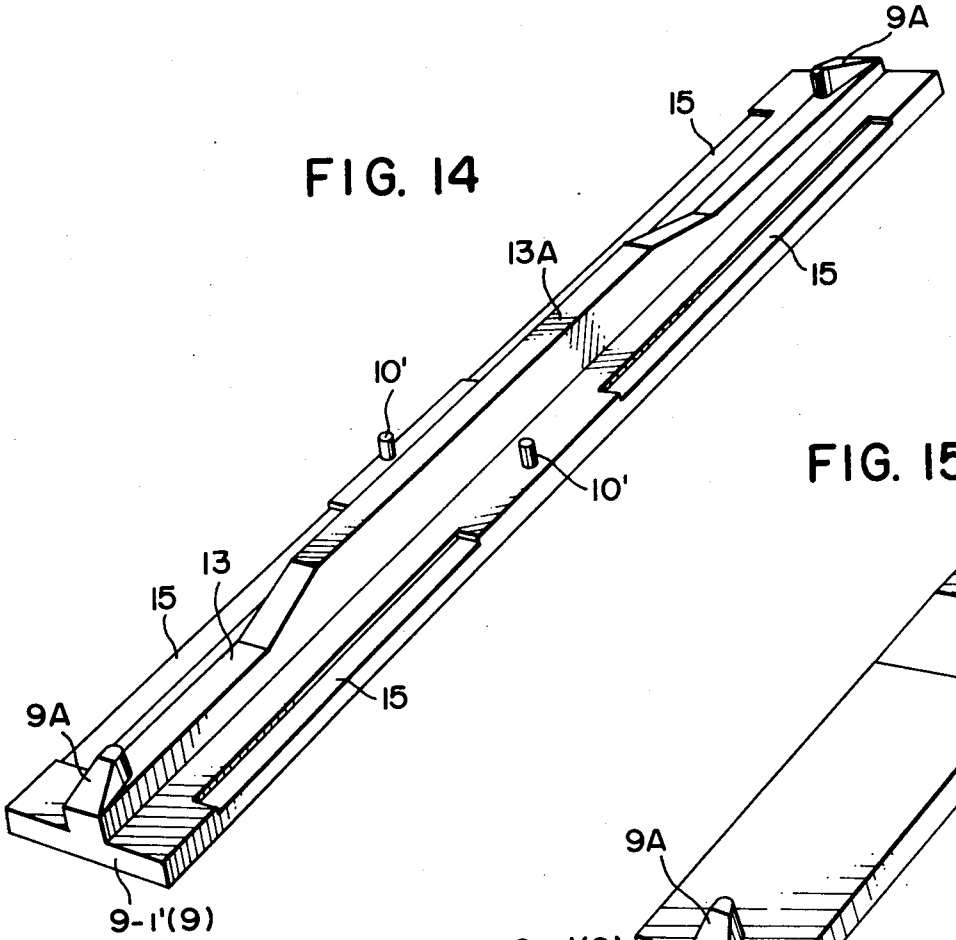

The above is a case when the projections 10 of the member $9_{-1}$ are provided near the ends and the holes 11 of the member $9_{-2}$ are provided also near the ends. As indicated in FIG. 14, however, the projections 10' may be provided at midpoint symmetrically to the longitudinal axis, while as indicated in FIG. 15, the holes 11' may be provided at the longitudinal center so that a large number of the members $9_{-1}$, and $9_{-2}$, can be continuously and alternately arranged in parallel with partial overlapping, as previously described.

Parallel arrangement of the members $9_{-1}$ and $9_{-2}$ in continuous alternation, as described above, makes it possible to keep the members parallel and the rate of decrease in the gas e between adjacent strengthening members constant under progressive displacements of the culvert sections in a direction perpendicular to the longitudinal directions of the culvert sections 1,1', thereby perfectly preventing a disorder like a tilting of the members relative to each other.

Figure 11:
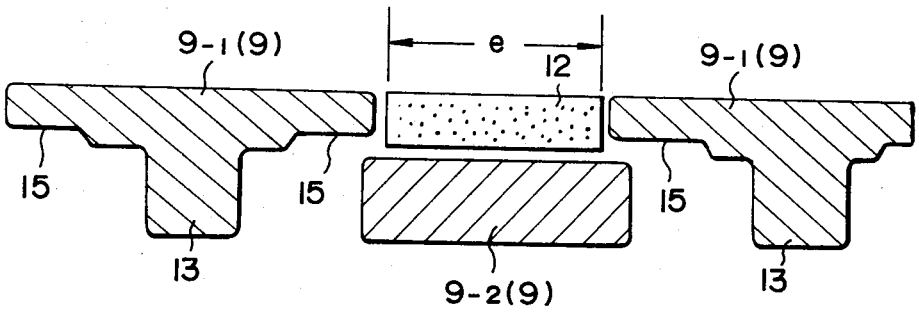
FIG. 11 is a section view showing a gap filling packing provided in the gap between the strengthening members.

FIG. 11 illustrates a case when packing or padding 12 is provided between the strengthening members 9 to fill the gap between the walls of the groups of the strengthening members arranged as above and shows sectionally the relation between the packing 12 and the strengthening member 9. The packing 12 is made of an elastic material such as rubber, synthetic resin or of a plastic material such as asphalt, or putty; this is provided for the purpose of preventing mud and sand or stones, etc. from getting into the gap and hindering smooth displacement of the culvert sections 1,1' in a direction perpendicular to the longitudinal directions of the culvert sections 1,1'.

Figure 12:
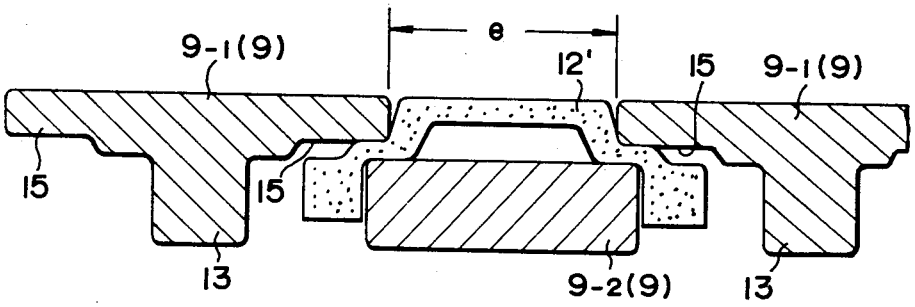
FIGS. 12 and 13 illustrate a different embodiment of the packing from the one shown in FIG. 11, FIG. 12 being a section view showing the relation between the strengthening member and packing in the initial state free from uneven subsidence and FIG. 13 being a section view showing the relation between the strengthening members at the outside of the joint and the packing after the uneven subsidence has attained the allowable limit.

Packing 12 to fill the gap e as illustrated by 12 in FIG. 11, can be a strip or a plate inserted in the space bounded by the sides of adjacent members $9_{-1}$,$9_{-1}$ and the outside of the members $9_{-2}$; or as illustrated by 12' in FIG. 12, it can be an elastic piece with a curved surface hugging the sides and outside of the members $9_{-2}$ in order to hinder the packing from coming off the strengthening members as well as to possibly reduce the deformation resistance and to absorb a great deal of uneven subsidence.

Figure 13:
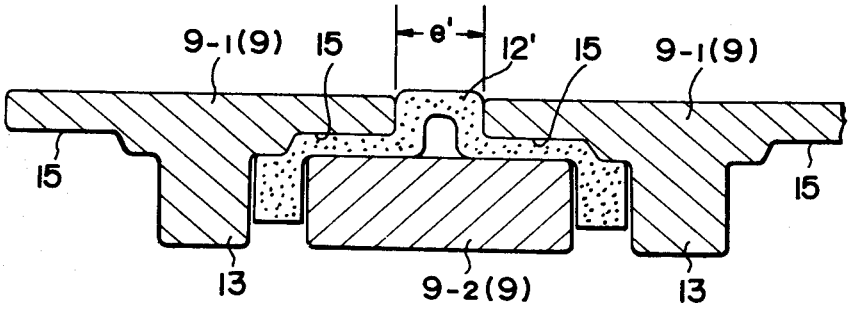

FIG. 13 illustrates the state of the strengthening members 9 and the packing when the uneven subsidence has reached the allowable limit.

It is better, if as illustrated in FIGS. 12 and 13 the packing 12' is set in grooves 15 provided on the members $9_{-1}$, and between two members $9_{-1}$,$9_{-1}$ and a member $9_{-2}$ so that it can flexibly follow the displacement of the strengthening member 9.

Such being the constitution, the culvert section according to the present invention has the following merits.

Since a large number of two types of the strengthening members are alternately arranged at the internal and external positions of the flexible member, with partial overlapping, with the projection fitting into the hole, the continuity of the members can always be maintained even when the culvert sections shift in the longitudinal direction and in the direction perpendicular to the longitudinal direction, thereby preventing any trouble due to a tilting of the members to one side. Thus it is not likely that a gap develops between the strengthening members arranged in parallel, and through which mud and sand could enter to cause loss of durability of, or damage to, the flexible member; or that a free displacement of the flexible member which is necessary to follow the uneven subsidence of culvert sections would be restrained by such invading mud and sand; or that in the case of water flowing in the culvert, the inside surface smoothness at the joint of the culverts is impeded, resulting in an increased resistance to water flow, which leads to deterioration in performance and durability of the joint of the culverts.

What is claimed is:

1. A culvert joint comprising;

opposed anchor members secured respectively to the opposed ends of a culvert section to be joined together, said culvert having an inside and an outside, said anchor members comprising hollow boxes presenting a seat, said boxes each having openings at the inside and outside of said seat which communicate with separate cavities within said boxes, a flexible member in the shape of a short tube, means connecting said flexible member to said seats of said opposed anchor members for isolating the inside of the culvert from the outside, a plurality of elongated first strengthening members each comprising opposite end portions of a thickness less than the size of said openings in said opposed anchor members, each first member having a projection thereon on each side of and generally symmetrical to its longitudinal axis, a plurality of elongated second strengthening members each comprising opposite end portions of a thickness less than the size of said openings in said opposed anchor members, each second member being elongated and having an opening therein on each side of and generally symmetrical to its longitudinal axis, said first and second members extending along the inside and along the outside of said flexible member in alternate arrays with said ends of the members extending through said openings of the anchor members and being displaceable in said cavities, said alternate arrays comprising alternate first and second members alternately overlapped, with a projection of each of said first members extending into an opening of the adjacent second member on each side of a first member to connect said members together for limited movement with respect to each other.

2. A culvert joint according to claim 1, wherein said projections of said first member comprise projections at the both longitudinal ends of the first strengthening members, and said holes of the second strengthening members comprise holes at both longitudinal ends of the second strengthening member.

3. A culvert joint according to claim 1, wherein said projections of the first members comprise projections provided centrally in the longitudinal direction of the first strengthening members, and said holes of said second members comprise holes located centrally in the longitudinal direction of the second strengthening member.

4. A culvert joint according to claim 1, wherein said projections of said first strengthening members comprise dowels extending upright from a surface thereof.

5. A culvert joint according to claim 1, wherein said holes of said second strengthening members each comprise a slot elongated in the longitudinal direction of said member.

6. A culvert joint according to claim 1 wherein said first and second members further comprise protruded portions at both longitudinal ends, said protruded portions being within said cavities of said anchor members and of a height greater than said openings of the anchor members so that said protruded portions prevent withdrawal of the ends of the members through said openings.

7. A culvert joint according to claim 1, wherein said first and second strengthening members further comprise raised central portions.

8. A culvert joint according to claim 7, wherein said raised portions on the first and second strengthening members have their tops essentially coplanar in said arrays.

9. A culvert joint according to claim 1, wherein deformable packing material is provided between the first and second strengthening members.

10. A culvert joint according to claim 9, wherein said padding comprises a strip or plate rectangular in section.

11. A culvert joint according to claim 9, wherein said padding comprising a strip with a curved section so as to surround the both ends and the outer surface of the second strengthening members.

12. A culvert joint according to claim 9, wherein said packing is made of resilient material.

13. A culvert joint according to claim 5, wherein each slot has a semi-circular shape.

14. A culvert joint according to claim 5, wherein each slot has a semi-elliptical shape.

15. A culvert joint according to claim 5, wherein each slot has a rectangular shape.

16. A culvert joint according to claim 5, wherein each slot has a long curved shape.

* * * * *